US006754987B1

(12) United States Patent
Cheng et al.

(10) Patent No.: US 6,754,987 B1
(45) Date of Patent: Jun. 29, 2004

(54) MAGAZINE LOADER FOR AMMUNITION PRELOADED WITH STRIPER CLIP

(75) Inventors: Carson Cheng, El Monte, CA (US); Jon Morgan, El Monte, CA (US)

(73) Assignee: New Century Sci. & Tech, Inc., El Monte, CA (US)

( * ) Notice: Subject to any disclaimer, the term of this patent is extended or adjusted under 35 U.S.C. 154(b) by 0 days.

(21) Appl. No.: 10/411,991

(22) Filed: Apr. 14, 2003

(51) Int. Cl.[7] ..... F41A 9/83
(52) U.S. Cl. ..... 42/87; 42/88; 42/90
(58) Field of Search ..... 42/87, 88, 90

(56) References Cited

U.S. PATENT DOCUMENTS

| | | | | | |
|---|---|---|---|---|---|
| 4,574,511 | A | * | 3/1986 | Csongor | 42/87 |
| 4,614,052 | A | * | 9/1986 | Brown et al. | 42/87 |
| 4,706,402 | A | * | 11/1987 | Csongor | 42/87 |
| 4,719,715 | A | * | 1/1988 | Howard | 42/87 |
| 4,872,279 | A | * | 10/1989 | Boat | 42/90 |
| 4,993,180 | A | * | 2/1991 | Upchurch | 42/87 |
| 5,355,606 | A | * | 10/1994 | Origoni | 42/87 |
| 5,402,594 | A | * | 4/1995 | Switzer | 42/90 |
| 6,286,243 | B1 | * | 9/2001 | Hinton | 42/87 |
| D477,047 | S | * | 7/2003 | Springer | D22/108 |

FOREIGN PATENT DOCUMENTS

| | | | |
|---|---|---|---|
| EP | 0205661 | * | 12/1986 |
| GB | 379179 | * | 8/1932 |

* cited by examiner

*Primary Examiner*—Michael J. Carone
*Assistant Examiner*—John Richardson
(74) *Attorney, Agent, or Firm*—Raymond Y. Chan; David and Raymond Patent Group

(57) ABSTRACT

A magazine loader includes a loading holder and an ammo pusher. The loading holder has a supplying opening end, an opposed discharging opening end, a feeding channel extended from the supplying opening end to the discharging opening end for slidably receiving a plurality of ammos, and a guiding arrangement provided within the feeding channel, wherein the discharging opening end of the loading holder is capable of detachably mounting on an opening of a magazine such that the feeding channel of the loading holder is adapted for aligning with the opening of the magazine. The ammo pusher, having a pusher head, is slidably engaged with the guiding arrangement to substantially guide the pusher head sliding from the supplying opening end of the loading holder to the discharging opening end thereof for pushing the ammos within the feeding channel of the loading holder into the magazine.

27 Claims, 4 Drawing Sheets

MAGAZINE LOADER FOR AMMUNITION PRELOADED WITH STRIPER CLIP

BACKGROUND OF THE PRESENT INVENTION

1. Field of Invention

The present invention relates to a magazine loading system, and more particularly to a magazine loader which can quickly and easily load the ammos into a magazine.

2. Description of Related Arts

Semi-automatic pistols generally comprises an ammunition magazine disposed in the handle portion of the pistol frame wherein rounds of ammunition stored in the magazine are individually fed from the magazine into the firing chamber of the pistol frame. The advantages of the magazine are the large capacity of ammunition storage and the quick loading operation to the pistol. Therefore, operators would like to preload the ammunition to the magazine before the combat operation. However, the conventional magazine has a major drawback.

In order to preload the magazine, the ammunition must be individually fed in the magazine one by one. It is known that at least ten ammunitions can be fed in the magazine for handgun and at least thirty ammunitions can be fed in the magazine for rifle. Therefore, the process of loading the ammunition in the magazine is a time-consuming.

As the need is sought for, a magazine loader is invented and incorporated with the magazine so that the ammunitions can be quickly and easy fed in the magazine. As shown in FIG. 1, the conventional magazine loader comprises a hollow loading frame detachably mounted on the magazine at the opening thereof and a clip holder attached at a rear wall of the loading frame, wherein a plurality of ammunitions are slidably held by an ammo clip and exposed out of the loading frame in such a manner that when the ammo clip is slid to the clip holder, the operator can apply a pressing force on the ammunitions so as to push the ammunitions slidably detached from the ammo clip and feed in the magazine.

However, the loading operation of such mechanism is unreliable because of a probability that the ammunitions will unevenly feed in the magazine by the pressing force of the operator. This adverse result affects the precise of feeding the ammunition from the magazine to the firing chamber of the pistol frame so that the ammunition will be jammed in the magazine. In other words, the ammunition loading operation of the conventional magazine loader leads to different operational results depending on the operators. In addition, the ammunitions may be accidentally exploded when an improperly external force is exerted thereon. Therefore, the conventional magazine loader can be considered disadvantageous in practical use.

SUMMARY OF THE PRESENT INVENTION

A main object of the present invention is to provide a magazine loader which can quickly and easily load the ammos into a magazine.

Another object of the present invention is to provide a magazine loader, wherein the ammos are disposed in a loading holder in position and pressed by an ammo pusher into the magazine, so that the ammos can precisely be fed in the magazine.

Another object of the present invention is to provide a magazine loader, wherein the loading holder has a slider rail to guide the ammo pusher in a slidably movable manner so that the ammo pusher can precisely push the ammos into the magazine.

Another object of the present invention is to provide a magazine loader, wherein a striper clip for holding the ammos is arranged to slidably insert into a guiding slot of the loading holder so that the ammos are retained in the loading holder in position and aligned with the opening of the magazine.

Another object of the present invention is to provide a magazine loader, wherein the ammo loading operation is easy and simply that by disposing the ammos in the loading holder and pushing by the ammo pusher to feed the ammos in the magazine.

Another object of the present invention is to provide a magazine loader, which can incorporate with any caliber of ammo without altering the original structure of the magazine.

Another object of the present invention is to provide a magazine loader, wherein no expensive or complicated structure is required to employ in the present invention in order to achieve the above mentioned objects. Therefore, the present invention successfully provides an economic and efficient solution for feeding the ammos in the magazine.

Accordingly, in order to accomplish the above objects, the present invention provides a magazine loader, comprising:

a loading holder having a supplying opening end, an opposed discharging opening end, a feeding channel extended from the supplying opening end to the discharging opening end for slidably receiving a plurality of ammos, and a guiding arrangement provided within the feeding channel, wherein the discharging opening end of the loading holder is capable of detachably mounting on an opening of a magazine such that the feeding channel of the loading holder is adapted for aligning with the opening of the magazine; and an ammo pusher, having a pusher head, slidably engaged with the guiding arrangement to substantially guide the pusher head sliding from the supplying opening end of the loading holder to the discharging opening end thereof for pushing the ammos within the feeding channel of the loading holder into the magazine.

These and other objectives, features, and advantages of the present invention will become apparent from the following detailed description, the accompanying drawings, and the appended claims.

DETAILED DESCRIPTION OF THE PREFERRED EMBODIMENT

Figure 1:
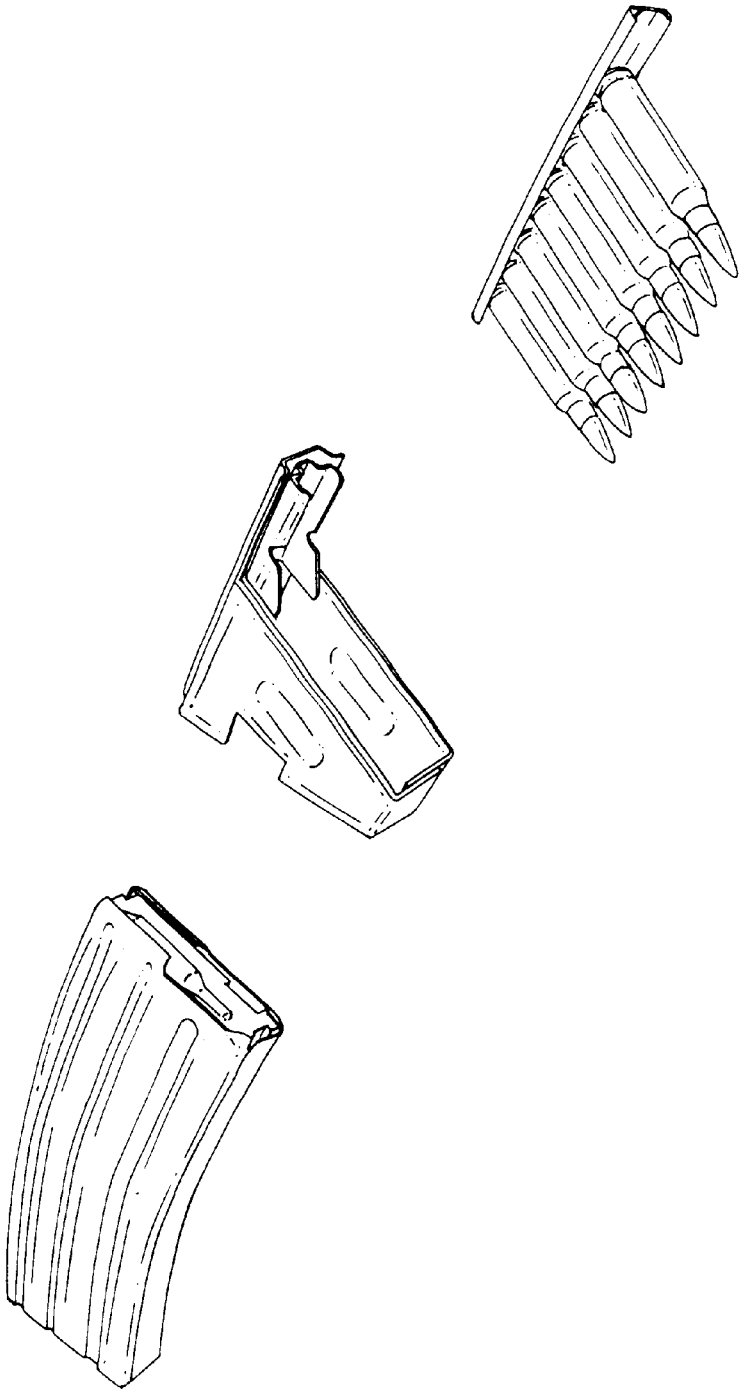
FIG. 1 PRIOR ART
FIG. 1 is a perspective view of a conventional magazine loader.
Figure 2:
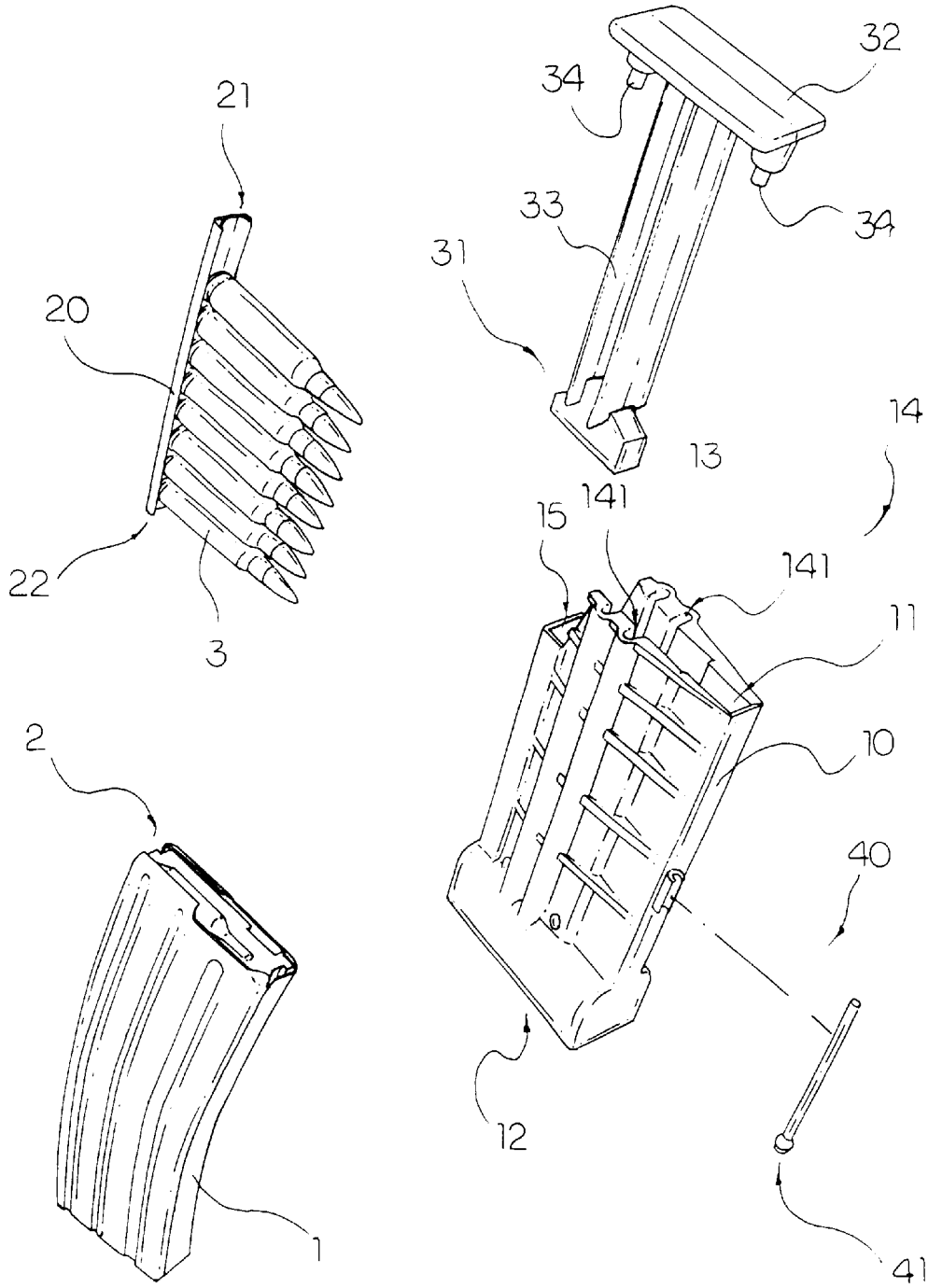
FIG. 2 is a perspective view of a magazine loader according to a preferred embodiment of the present invention.

Referring to FIG. 2 of the drawings, a magazine loader according to a preferred embodiment of the present invention is illustrated, wherein the magazine loader comprises a loading holder 10, striper clip 20, and an ammo pusher 30.

The loading holder 10 has a supplying opening end 11, an opposed discharging opening end 12, a feeding channel 13 extended from the supplying opening end 11 to the discharging opening end 12, and a guiding arrangement 14 provided within the feeding channel 13, wherein the discharging opening end 12 of the loading holder 10 is capable of detachably mounting on an opening 2 of a magazine 1 such that the feeding channel 13 of the loading holder 10 is adapted for aligning with the opening 2 of the magazine 1.

The striper clip 20 is slidably disposed in the feeding channel 13 through the supplying opening end 11, wherein the striper clip 20 is arranged for holding a plurality of ammos 3 in position so as to guide the ammos 3 within the feeding channel 13 to align with the opening 2 of the magazine 1.

The ammo pusher 30, having a pusher head 31, is slidably engaged with the guiding arrangement 14 to substantially guide the pusher head 31 sliding from the supplying opening end 11 of the loading holder 10 to the discharging opening end 12 thereof for pushing the ammos 3 within the feeding channel 13 of the loading holder 10 into the magazine 1.

According to the preferred embodiment, the loading holder 10 has a hollow shape defining the feeding channel 13 therein wherein the feeding channel 13 has a size adapted for receiving a predetermined caliber ammo 3 that fits into the magazine 1. Moreover, when the loading holder 10 is mounted on the magazine 1, the feeding channel 13 of the loading holder 10 is capable of communicating with a chamber of the magazine 1 through the opening 2 thereof.

A width of the feeding channel 13 of the loading holder 10 is gradually reduced from the supplying opening end 11 to the discharging opening end 12 in such a manner that when the ammos 3 are disposed in the feeding channel 13 through the supplying opening end 11 of the loading holder 10, the ammos 3 can be frictionally held between two sidewalls of the loading holder 10 so as to retain the ammos 3 within the feeding holder 10. However, the ammos 3 are capable of passing through the discharging opening end 12 of the loading holder 10 when a downward force is applied on the ammos 3 via the ammo pusher 30.

The discharging opening end 12 of the loading holder 10 is shaped as a magazine socket adapted for the magazine 1 detachably inserting thereinto, so as to align the discharging opening end 12 of the loading holder 10 with respect to the opening 2 of the magazine 1.

The guiding arrangement 14 has at least two slider rails 141 indently formed on the two sidewalls of the loading holder 10 to slidably engage with two side edges of the ammo pusher 30 respectively wherein each of the slider rails 141 is extended from the supplying opening end 11 of the loading holder 10 to the discharging opening end 12 thereof, so as to guide the pusher head 31 of the ammo pusher 30 to slide between the supplying opening end 11 and the discharging opening end 12 of the loading holder 10.

Figure 3:
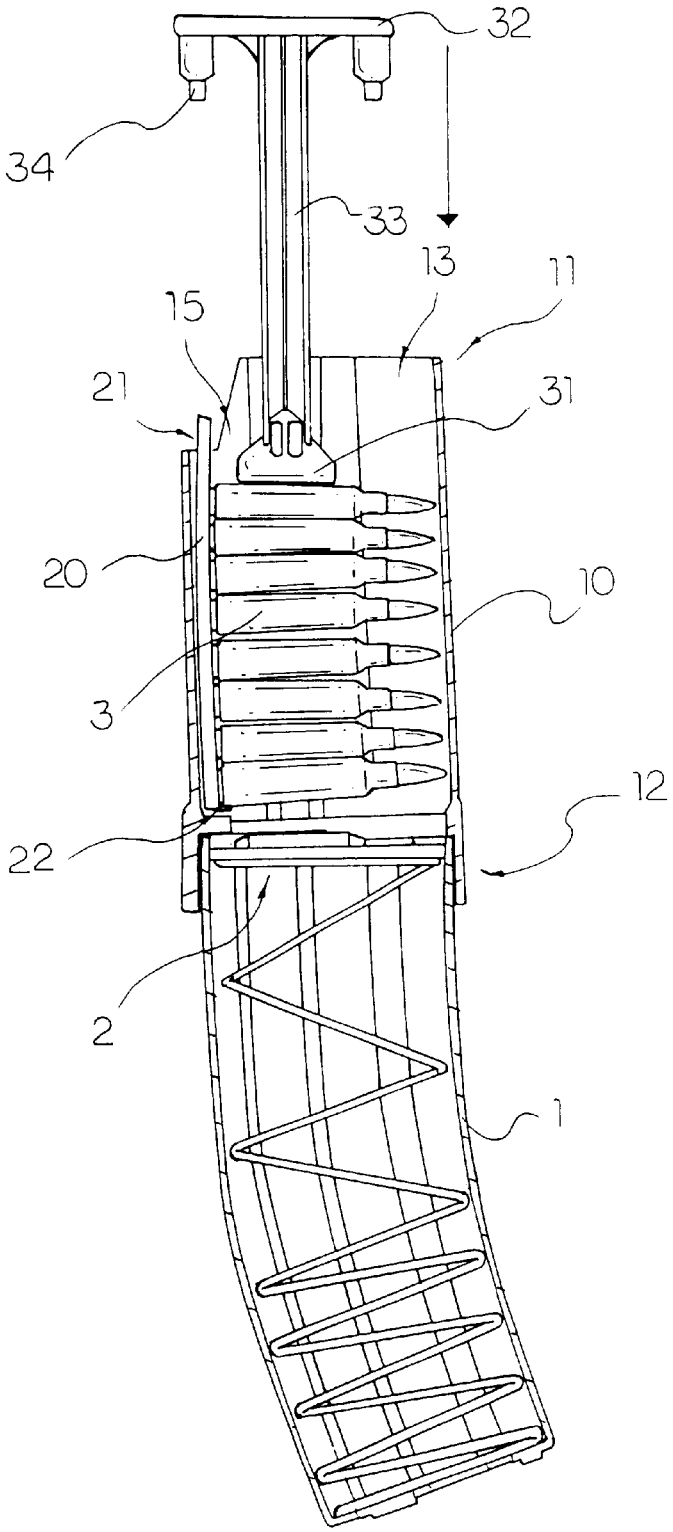
FIG. 3 is a sectional view of a loading holder of the magazine loader according to the above preferred embodiment of the present invention, illustrating the ammos being alignedly disposed in the feeding channel of the loading holder.

As shown in FIGS. 2 and 3, the loading holder 10 further has a guiding slot 15 provided at a rear side of the feeding channel 13, wherein the striper clip 20 is guided to slide along the guiding slot 15 for ensuring the ammos 3 retained in the feeding channel 13 in position. In other words, when the striper clip 20 is slid into the guiding slot 15, the ammos 3 are automatically guided in the feeding channel 13 to align with the opening 2 of the magazine 1. In addition, the loading holder 10 further comprises a clip stopper 151 formed within the guiding slot 15 at the discharging opening end 12 of the loading holder 10 in such a manner that when the striper clip 20 is slid into the guiding slot 15, the striper clip 20 is stopped at the clip stopper 151 for securely holding the ammos 3 within the feeding channel 13 in position.

The striper clip 20, according to the preferred embodiment, is an ammo clip having an inserting end 21, an opposed stopper end 22, and an elongated holding groove 23 extended from the inserting end 21 to the stopper end 22 for slidably holding rear end portions of the ammos 3 therebetween. The striper clip 20 has a predetermined height for slidably holding a predetermined number of ammos 3, such as ten ammos, along the holding groove 23. Preferably, the height of the loading holder 10 is at least larger the height of the striper clip 20 in such a manner that when the striper clip 20 is slidably disposed in the guiding slot 15 of the loading holder 10, all the ammos 3 held by the striper clip 20 are received in the feeding channel 13. Therefore, the loading holder 10 can protect the ammos 3 during the feeding operation since no ammo 3 is exposed out of the feeding channel 13.

Figure 4:
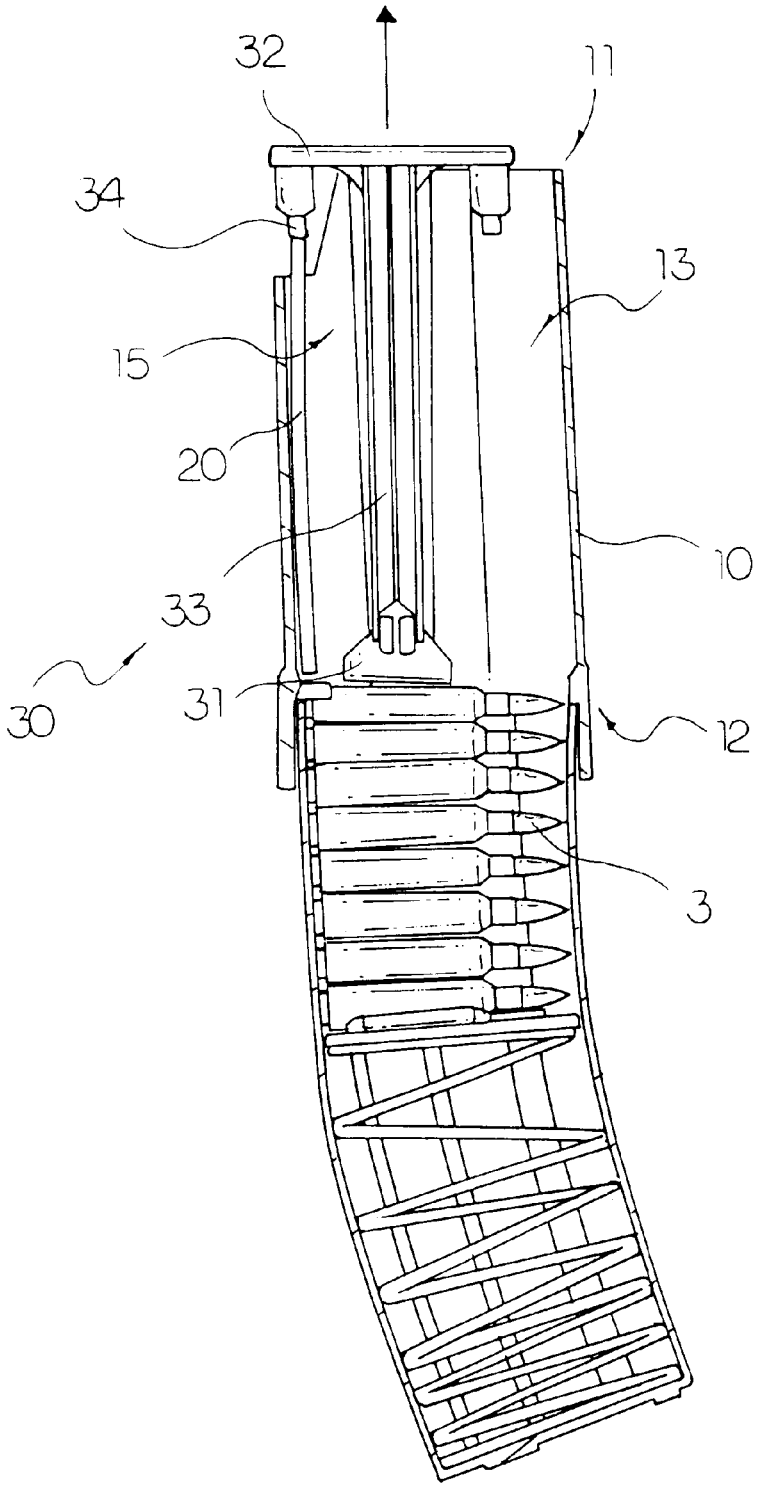
FIG. 4 is a sectional view of the magazine loader according to the above preferred embodiment of the present invention, illustrating the ammos being pushed into the magazine via the ammo pusher.

The ammo pusher 30 is detachably mounted to the loading holder 10 in a slidably movable manner. The ammo pusher 30 further comprises a pusher platform 32 and an elongated pusher body 33 downwardly extended therefrom while the pusher head 31 is formed at a bottom end of the pusher body 33, wherein the pusher platform 32 is arranged to be stopped at the supplying opening end 11 of the loading holder 10 when the pusher head 31 is positioned at the discharging opening end 12 of the loading holder 10 for ensuring all the ammos 3 within the feeding channel 13 being fed in the magazine 1, as shown in FIG. 4.

In other words, when the ammo pusher 30 is slidably engaged with the guiding arrangement 14 of the loading holder 10, the pusher platform 32 is arranged to be driven towards the feeding channel 13 so as to push the pusher head 31 towards the discharging opening end 12 through the pusher platform 32 for feeding the ammos 3 within the feeding channel 13 into the magazine 1.

As shown in FIG. 2, the two side edges of the pusher body 33 is slidably engaged with the guiding rails 141 of the guiding arrangement 14 respectively, wherein the pusher body 33 has a predetermined length adapted to drive the pusher head 31 from the supplying opening end 11 of the loading holder 10 to the feeding opening end 12 thereof, so as to pushes the ammos 3 within the feeding channel 13 into the magazine 1.

Accordingly, the pusher head 31 of the ammo pusher 30 has an enlarged bottom engaging surface 311 for enlarging a contacting surface of the pusher head 31 with respect to the uppermost ammo 3. Therefore, when a downward force is applied on the ammo pusher 30, the downward force is evenly distributed through the engaging surface 311 of the pusher head 31 to substantially push the ammos 3 into the magazine 1. In other words, the engaging surface 311 of the pusher head 31 ensures a proper external force, i.e. the downward force, exerted on the ammos 3 so as to prevent an accidental explosion of the ammo 3.

The ammo pusher 30 further comprises a clip retraction element 34 provided at the pusher platform 32 to detachably engage with the striper clip 20 when the pusher head 31 is slidably moved at the discharging opening end 12 of the loading holder 10. As shown in FIG. 3, the clip retraction element 34 is a magnet mounted at a bottom side of the pusher platform 32 and aligned with the guiding slot 15 of the loading holder 10, wherein the striper clip 20 is made of magnetic attraction ability material, such as iron, in such a manner that when the ammo pusher 30 is slidably pushed in the feeding channel 13 until the pusher head 31 is positioned at the discharging opening end 12 of the loading holder 10, i.e. all the ammos 3 within the feeding channel 13 are fed in the magazine 1, the clip retraction element 34 is magnetically engaged with the striper clip 20, so that when the ammo pusher 30 is pulled out from the feeding channel 13, the striper clip 20 is pulled out from the guiding slot 15. In other words, after all the ammos 3 within the feeding channel 13 are fed in the magazine 1, the operator is able to empty the feeding channel 13 once the operator pulls out the ammo pusher 30 with the striper clip 20 at the same time.

It is obvious that the clip retraction element 34 can be embodied as a latch downwardly extended from the pusher platform 32 in such a manner that when the pusher platform 32 is stopped at the supplying opening end 11 of the loading holder 10, the latch of the clip retraction element 34 is detachably locked with the striper clip 20, so that the striper clip 20 is pulled out from the guiding slot 15 when the ammo pusher 30 is pulled out from the feeding channel 13.

As shown in FIG. 2, the magazine loader further comprises an ammo discharger 40 detachably mounted at the loading holder 10 wherein the ammo discharger 40 has a discharging head 41 adapted for pushing the ammo 3 out of the magazine 1 at the opening 2 thereof so as to unload the ammos 3 in the magazine 1. Alternatively, the ammo pusher 30 is capable of functions as the ammo discharger 40 wherein the discharging head 41 of the ammo discharger 40 is formed at the pusher head 31 of the ammo pusher 30 in such a manner that the ammo pusher 30 is arranged to not only push the ammos 3 into the magazine 1 through the loading holder 10 but also discharge the ammos 3 from the magazine 1.

In order to load the ammos 3 in the magazine 1, the operator is able to mount the loading holder 10 on the magazine 1 by inserting the opening 2 of the magazine 1 into the magazine socket of the loading holder 10 at the discharging opening end 12 thereof so that the feeding channel 13 is alignedly communicated with the magazine 1 through the opening 2 thereof. Then, the operator is able to clip the ammos 3 at the striper clip 20 along the holding groove 23 at the inserting end 21 thereof and slidably insert the striper clip 20 in the holding slot 15 of the loading holder 10 through the supplying opening end 11 so that the ammos 3 held by the ammos 3 are alignedly disposed in the feeding channel 13 of the loading frame 10. Therefore, by slidably engaging the ammo pusher 30 with the guiding rails 141 of the guiding arrangement 14 of the loading holder 10, the operator can apply a downward force on the pusher platform 32 of the ammo pusher 30 to move the pusher head 31 from the supplying opening end 11 of the loading holder 10 to the discharging opening end 12 through the feeding channel 13 so as to substantially push the ammos 3 within the feeding channel 13 in the magazine 1. It is worth to mention that the striper clip 20 is an optional tool to feed the ammos 3 into the magazine 1. If a smaller caliber of ammo 3 is used, the operator is able to directly slide the ammo 3 into the feeding channel 13 and push the ammo 3 into the magazine 1. However, the striper is clip 20 provides a quick and easy loading operation when the ammos 3 are held by the striper clip 20, especially a larger caliber of ammo 3.

Therefore, the operator can easily clip the ammos 3 on the striper clip 20 and repeatedly feed the ammos 3 in the magazine 1 via the loading holder 10 and the ammo pusher 30 until the magazine 1 is fully loaded with the ammos 3. In addition, since the loading operation is easy and simply that by pressing the ammo pusher 30 to push the ammos 3 in the magazine 1, an individual is able to carry a plurality of striper clips 20 with the ammos 3 held thereon so as to reload the magazine 1 in the shooting range.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A magazine loader for loading ammos in a magazine having an opening, comprising:

a loading holder having a supplying opening end, an opposed discharging opening end, a feeding channel extended from said supplying opening end to said discharging opening end for slidably receiving the ammos, and a guiding arrangement provided within said feeding channel, wherein said discharging opening end of said loading holder is capable of detachably mounting on the opening of the magazine so as to alignedly communicate said feeding channel with the opening of the magazine; and an ammo pusher, having a pusher head, slidably engaged with said guiding arrangement to substantially guide said pusher head sliding from said supplying opening end of said loading holder to said discharging opening end thereof for pushing the ammos within said feeding channel of said loading holder into the magazine.

2. A magazine loader, as recited in claim 1, further comprising a striper clip slidably disposed in said feeding channel through said supplying opening end, wherein said striper clip is arranged for holding said ammos in position so as to guide said ammos within said feeding channel to align with said opening of said magazine.

3. A magazine loader, as recited in claim 1, wherein said guiding arrangement has at least two slider rails formed on two sidewalls of said loading holder to slidably engage with two side edges of said ammo pusher respectively, wherein each of said slider rails is extended from said supplying opening end of said loading holder to said discharging opening end thereof, so as to guide said pusher head of said ammo pusher to slide between said supplying opening end and said discharging opening end of said loading holder.

4. A magazine loader, as recited in claim 2, wherein said guiding arrangement has at least two slider rails formed on two sidewalls of said loading holder to slidably engage with two side edges of said ammo pusher respectively, wherein each of said slider rails is extended from said supplying opening end of said loading holder to said discharging opening end thereof, so as to guide said pusher head of said ammo pusher to slide between said supplying opening end and said discharging opening end of said loading holder.

5. A magazine loader, as recited in claim 2, wherein said loading holder further has a guiding slot provided at a rear side of said feeding channel, wherein said striper clip is guided to slide along said guiding slot for ensuring said ammos retained in said feeding channel in position.

6. A magazine loader, as recited in claim 4, wherein said loading holder further has a guiding slot provided at a rear side of said feeding channel, wherein said striper clip is guided to slide along said guiding slot for ensuring said ammos retained in said feeding channel in position.

7. A magazine loader, as recited in claim 5, wherein said loading holder further comprises a clip stopper formed within said guiding slot at said discharging opening end of said loading holder in such a manner that when said striper clip is slid into said guiding slot, the striper clip is stopped at said clip stopper for securely holding said ammos within said feeding channel in position.

8. A magazine loader, as recited in claim 6, wherein said loading holder further comprises a clip stopper formed within said guiding slot at said discharging opening end of said loading holder in such a manner that when said striper clip is slid into said guiding slot, the striper clip is stopped at said clip stopper for securely holding said ammos within said feeding channel in position.

9. A magazine loader, as recited in claim 1, wherein said ammo pusher further comprises a pusher platform and an elongated pusher body downwardly extended therefrom while said pusher head is formed at a bottom end of said pusher body, wherein said pusher body has a predetermined length that when said pusher platform is stopped at said supplying opening end of said loading holder when said pusher head is positioned at said discharging opening end of said loading holder for ensuring said ammos within feeding channel being fed in said magazine.

10. A magazine loader, as recited in claim 2, wherein said ammo pusher further comprises a pusher platform and an elongated pusher body downwardly extended therefrom while said pusher head is formed at a bottom end of said pusher body, wherein said pusher body has a predetermined length that when said pusher platform is stopped at said supplying opening end of said loading holder when said pusher head is positioned at said discharging opening end of said loading holder for ensuring said ammos within feeding channel being fed in said magazine.

11. A magazine loader, as recited in claim 4, wherein said ammo pusher further comprises a pusher platform and an elongated pusher body downwardly extended therefrom while said pusher head is formed at a bottom end of said pusher body, wherein said pusher body has a predetermined length that when said pusher platform is stopped at said supplying opening end of said loading holder when said pusher head is positioned at said discharging opening end of said loading holder for ensuring said ammos within feeding channel being fed in said magazine.

12. A magazine loader, as recited in claim 8, wherein said ammo pusher further comprises a pusher platform and an elongated pusher body downwardly extended therefrom while said pusher head is formed at a bottom end of said pusher body, wherein said pusher body has a predetermined length that when said pusher platform is stopped at said supplying opening end of said loading holder when said pusher head is positioned at said discharging opening end of said loading holder for ensuring said ammos within feeding channel being fed in said magazine.

13. A magazine loader, as recited in claim 9, wherein said ammo pusher further comprises a clip retraction element provided at said pusher platform to detachably engage with said striper clip when said pusher head is slidably moved at said discharging opening end of said loading holder, so that when said ammo pusher is slidably pulled out from said feeding channel, said striper clip is automatically pulled out from said loading holder at the same time.

14. A magazine loader, as recited in claim 10, wherein said ammo pusher further comprises a clip retraction element provided at said pusher platform to detachably engage with said striper clip when said pusher head is slidably moved at said discharging opening end of said loading holder, so that when said ammo pusher is slidably pulled out from said feeding channel, said striper clip is automatically pulled out from said loading holder at the same time.

15. A magazine loader, as recited in claim 11, wherein said ammo pusher further comprises a clip retraction element provided at said pusher platform to detachably engage with said striper clip when said pusher head is slidably moved at said discharging opening end of said loading holder, so that when said ammo pusher is slidably pulled out from said feeding channel, said striper clip is automatically pulled out from said loading holder at the same time.

16. A magazine loader, as recited in claim 12, wherein said ammo pusher further comprises a clip retraction element provided at said pusher platform to detachably engage with said striper clip when said pusher head is slidably moved at said discharging opening end of said loading holder, so that when said ammo pusher is slidably pulled out from said feeding channel, said striper clip is automatically pulled out from said loading holder at the same time.

17. A magazine loader, as recited in claim 13, wherein said clip retraction element is a magnet mounted at a bottom side of said pusher platform and said striper clip is made of magnetic attraction ability material, in such a manner that when said ammo pusher is slidably pushed in said feeding channel until said pusher head is positioned at said discharging opening end of said loading holder, said clip retraction element is magnetically engaged with said striper clip.

18. A magazine loader, as recited in claim 14, wherein said clip retraction element is a magnet mounted at a bottom side of said pusher platform and said striper clip is made of magnetic attraction ability material, in such a manner that when said ammo pusher is slidably pushed in said feeding channel until said pusher head is positioned at said discharging opening end of said loading holder, said clip retraction element is magnetically engaged with said striper clip.

19. A magazine loader, as recited in claim 15, wherein said clip retraction element is a magnet mounted at a bottom side of said pusher platform and said striper clip is made of magnetic attraction ability material, in such a manner that when said ammo pusher is slidably pushed in said feeding channel until said pusher head is positioned at said discharging opening end of said loading holder, said clip retraction element is magnetically engaged with said striper clip.

20. A magazine loader, as recited in claim 16, wherein said clip retraction element is a magnet mounted at a bottom side of said pusher platform and said striper clip is made of magnetic attraction ability material, in such a manner that when said ammo pusher is slidably pushed in said feeding channel until said pusher head is positioned at said discharging opening end of said loading holder, said clip retraction element is magnetically engaged with said striper clip.

21. A magazine loader, as recited in claim 2, wherein said pusher head of said ammo pusher has an enlarged bottom engaging surface for enlarging a contacting surface of said pusher with respective to said respective ammo within said feeding channel so as to evenly distribute a pushing force from said pusher head on said ammos.

22. A magazine loader, as recited in claim 6, wherein said pusher head of said ammo pusher has an enlarged bottom engaging surface for enlarging a contacting surface of said pusher with respective to said respective ammo within said feeding channel so as to evenly distribute a pushing force from said pusher head on said ammos.

23. A magazine loader, as recited in claim 8, wherein said pusher head of said ammo pusher has an enlarged bottom engaging surface for enlarging a contacting surface of said pusher with respective to said respective ammo within said feeding channel so as to evenly distribute a pushing force from said pusher head on said ammos.

24. A magazine loader, as recited in claim 12, wherein said pusher head of said ammo pusher has an enlarged bottom engaging surface for enlarging a contacting surface of said pusher with respective to said respective ammo within said feeding channel so as to evenly distribute a pushing force from said pusher head on said ammos.

25. A magazine loader, as recited in claim 8, further comprising an ammo discharger detachably mounted at said loading holder, wherein said ammo discharger has a discharging head adapted for pushing said ammo out of said magazine at said opening thereof so as to unload said ammos in said magazine.

26. A magazine loader, as recited in claim 16, further comprising an ammo discharger detachably mounted at said loading holder, wherein said ammo discharger has a discharging head adapted for pushing said ammo out of said magazine at said opening thereof so as to unload said ammos in said magazine.

27. A magazine loader, as recited in claim 24, further comprising an ammo discharger detachably mounted at said loading holder, wherein said ammo discharger has a discharging head adapted for pushing said ammo out of said magazine at said opening thereof so as to unload said ammos in said magazine.

* * * * *